US009234671B2

(12) United States Patent
Yasutomi et al.

(10) Patent No.: US 9,234,671 B2
(45) Date of Patent: Jan. 12, 2016

(54) AIR CONDITIONING INDOOR UNIT

(75) Inventors: Masanao Yasutomi, Kusatsu (JP); Takahiro Okamoto, Kusatsu (JP); Masashi Kamada, Sakai (JP); Hironobu Teraoka, Sakai (JP); Noriyuki Okuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/345,780

(22) PCT Filed: Sep. 5, 2012

(86) PCT No.: PCT/JP2012/072585
§ 371 (c)(1),
(2), (4) Date: Mar. 19, 2014

(87) PCT Pub. No.: WO2013/047126
PCT Pub. Date: Apr. 4, 2013

(65) Prior Publication Data

US 2014/0227961 A1 Aug. 14, 2014

(30) Foreign Application Priority Data

Sep. 30, 2011 (JP) ..... 2011-217494

(51) Int. Cl.
*F24F 11/02* (2006.01)
*F15C 4/00* (2006.01)
(Continued)

(52) U.S. Cl.
CPC ..... *F24F 11/022* (2013.01); *F15C 4/00* (2013.01); *F24F 1/0011* (2013.01);
(Continued)

(58) Field of Classification Search
CPC ..... F15C 4/00; F24F 1/0011; F24F 11/0078; F24F 11/022; F24F 13/14; F24F 2221/28
USPC ..... 454/325; 137/829
See application file for complete search history.

(56) References Cited

U.S. PATENT DOCUMENTS 4,738,116 A * 4/1988 Himeno et al. ..... 454/319
2008/0053131 A1* 3/2008 Yasutomi et al. ..... 62/262
(Continued)

FOREIGN PATENT DOCUMENTS

EP 0 819 894 A2 1/1998
JP 10-009659 A 1/1998
(Continued)

OTHER PUBLICATIONS

European Search Report of corresponding EP Application No. 12 83 5047.7 dated Jul. 2, 2014.
(Continued)

*Primary Examiner* — Alissa Tompkins
*Assistant Examiner* — Phillip E Decker
(74) *Attorney, Agent, or Firm* — Global IP Counselors

(57) ABSTRACT

An air conditioning indoor unit includes a movable first air direction adjustment plate that changes an up and down direction of the outlet air, a second air direction adjustment plate disposed adjacent to the air outlet, and a control unit that controls postures of the first and second adjustment plates. The second adjustment plate has at least a front end portion housed in an indoor unit front portion outside a blowing path when housed. In a Coanda effect utilization mode the control unit controls the postures of the first and second adjustment plates such that the second adjustment plate is spaced apart from the indoor unit front portion and a height position of a rear end portion is lower than when operation is stopped, and the adjustment plates form a predetermined angle to change the outlet air to a Coanda air flow along an undersurface of the second adjustment plate.

9 Claims, 7 Drawing Sheets

(51) Int. Cl.
*F24F 13/14* (2006.01)
*F24F 1/00* (2011.01)
*F24F 11/00* (2006.01)

(52) U.S. Cl.
CPC ..... *F24F 11/0078* (2013.01); *F24F 13/14* (2013.01); *F24F 2001/0048* (2013.01); *F24F 2221/28* (2013.01); *Y10T 137/2202* (2015.04)

(56) References Cited

U.S. PATENT DOCUMENTS

2014/0273805 A1* 9/2014 Yasutomi ..... F24F 13/10 454/322
2014/0308888 A1* 10/2014 Yasutomi ..... F24F 13/14 454/284
2014/0315482 A1* 10/2014 Yasutomi ..... F24F 1/0011 454/338
2015/0087219 A1* 3/2015 Yasutomi ..... F24F 11/0078 454/256
2015/0153063 A1* 6/2015 Yasutomi ..... F24F 1/0011 454/241

FOREIGN PATENT DOCUMENTS

JP 2002-61938 A 2/2002
JP 2004-361011 A 12/2004
JP 2005164068 A * 6/2005 ..... F24F 11/02
JP 2007-51866 A 1/2007
JP 2007-93092 A 4/2007
JP 2009-97755 A 5/2009
JP 2011-47624 A 3/2011
JP 2011-75238 A 4/2011
JP 2012-197970 A 10/2012

OTHER PUBLICATIONS

International Preliminary Report of corresponding PCT Application No. PCT/JP2012/072585 dated Apr. 10, 2014.

* cited by examiner

AIR CONDITIONING INDOOR UNIT

CROSS-REFERENCE TO RELATED APPLICATIONS

This U.S. National stage application claims priority under 35 U.S.C. §119(a) to Japanese Patent Application No. 2011-217494, filed in Japan on Sep. 30, 2011, the entire contents of which are hereby incorporated herein by reference.

TECHNICAL FIELD

The present invention relates to an air conditioning indoor unit.

BACKGROUND ART

In air conditioning apparatus, it is necessary to deliver the outlet air far in order to equalize the temperature distribution in an entire room. For example, in the air conditioner disclosed in JP-A No. 2002-61938, a front sloping portion of a front panel has a shape that slopes gently toward the ceiling. When conditioned air blown out from an air outlet has been deflected toward the from sloping portion by an up and down air direction plate, the conditioned air is guided along the front sloping portion in the direction of the ceiling. As a result, the conditioned air can be delivered farther along the ceiling surface.

SUMMARY

Technical Problem

However, in the air conditioner described above, in order to direct the conditioned air toward the front panel, the up and down air direction plate moves closer to the upper end portion of the air outlet and obstructs the air outlet, so pressure loss increases.

It is a problem of the present invention to provide an air conditioning indoor unit that can guide outlet air in a predetermined direction without increasing pressure loss that much.

Solution to Problem

An air conditioning indoor unit pertaining to a first aspect of the present invention is an air conditioning indoor unit having a Coanda effect utilization mode that utilizes the Coanda effect to guide, in a predetermined direction, a flow of outlet air blown out from an air outlet, the air conditioning indoor unit comprising a first air direction adjustment plate, a second air direction adjustment plate, and a control unit. The first air direction adjustment plate is a movable adjustment plate that changes an up and down direction of the outlet air. The second air direction adjustment plate is disposed in the neighborhood of the air outlet and, when housed, has at least a front end portion housed in an indoor unit front portion outside a blowing path. The control unit controls postures of the first air direction adjustment plate and the second air direction adjustment plate. Furthermore, in the Coanda effect utilization mode, the control unit controls the postures of the first air direction adjustment plate and the second air direction adjustment plate in such a way that the second air direction adjustment plate assumes a posture in which it is spaced apart from the indoor unit front portion and the second air direction adjustment plate and the first air direction adjustment plate form a predetermined angle to thereby change the outlet air to a Coanda air flow along an undersurface of the second air direction adjustment plate.

In this air conditioning indoor unit, by executing the Coanda effect utilization mode, the outlet air whose air direction has been adjusted by the first air direction adjustment plate can be changed to a Coanda air flow which, because of the Coanda effect, flows along the undersurface of the second air direction adjustment plate positioned away from the indoor unit front portion. As a result, compared to a conventional configuration that generates an air flow along the front panel, it becomes possible for the outlet air to be guided in a predetermined direction with the air outlet remaining unobstructed. That is, the outlet air is guided in a predetermined direction in a state in which air resistance is kept low.

An air conditioning indoor unit pertaining to a second aspect of the present invention is the air conditioning indoor unit pertaining to the first aspect, further comprising a scroll that guides air-conditioned air to the air outlet. When the control unit executes the Coanda effect utilization mode, the first air direction adjustment plate and the second air direction adjustment plate assume postures that satisfy a condition where an internal angle formed by a tangent to a terminal end portion of the scroll and the second air direction adjustment plate is greater than an internal angle formed by the tangent to the terminal end portion of the scroll and the first air direction adjustment plate.

In this air conditioning indoor unit, it becomes possible for the outlet air to be deflected to a large extent from the direction tangential to the terminal end portion of the scroll. Therefore, the outlet air is directed toward the ceiling surface and is delivered far along the ceiling surface.

An air conditioning indoor unit pertaining to a third aspect of the present invention is the air conditioning indoor unit pertaining to the first aspect or the second aspect, wherein in the Coanda effect utilization mode, a front end portion of the second air direction adjustment plate points frontward and upward from a horizontal.

In this air conditioning indoor unit, even when the outlet air whose air direction has been adjusted by the first air direction adjustment plate is horizontal or a little downward, it becomes upward air because of the Coanda effect, so it is not necessary for the air just after passage through the air outlet to be forcibly directed upward. That is, the air direction is changed while pressure loss caused by the air resistance of the first air direction adjustment plate is suppressed.

An air conditioning indoor unit pertaining to a fourth aspect of the present invention is the air conditioning indoor unit pertaining to the third aspect, wherein in the Coanda effect utilization mode, the front end portion of the second air direction adjustment plate is positioned higher than the air outlet.

For example, in a case where the front end of the second air direction adjustment plate is in the blowing path, there is the potential for the Coanda air flow along the undersurface of the second air direction adjustment plate to interfere with the outlet air that has passed over the upper side of the second air direction adjustment plate so that the travel of the upward air flow is impeded.

In contrast, in this air conditioning indoor unit, the front end portion of the second air direction adjustment plate is positioned higher than the air outlet, so the generation of a strong air flow on the upper side of the second air direction adjustment plate is suppressed. Therefore, it becomes difficult for the upward guidance of the Coanda air flow to be impeded.

An air conditioning indoor unit pertaining to a fifth aspect of the present invention is the air conditioning indoor unit pertaining to any one of the first aspect to the fourth aspect, wherein in the Coanda effect utilization mode, the height position of a rear end portion of the second air direction adjustment plate is lower than it is when operation is stopped.

In this air conditioning indoor unit, the rear end portion of the second air direction adjustment plate enters the upstream side of the traveling path of the outlet air whose air direction has been adjusted by the first air direction adjustment plate, so compared to a type where the rear end portion does not move, it becomes easy for a Coanda air flow resulting from the Coanda effect further on the upstream side to be produced.

An air conditioning indoor unit pertaining to a sixth aspect of the present invention is the air conditioning indoor unit pertaining to any one of the first aspect to the fifth aspect, wherein in the Coanda effect utilization mode, the front end portion of the second air direction adjustment plate projects outward from the air outlet.

In this air conditioning indoor unit, the front end portion of the second air direction adjustment plate projects outward from the air outlet, so the Coanda air flow reaches farther.

An air conditioning indoor unit pertaining to a seventh aspect of the present invention is the air conditioning indoor unit pertaining to the sixth aspect, wherein in the Coanda effect utilization mode, the second air direction adjustment plate is controlled to a posture in which it becomes further away from the indoor unit front portion heading frontward.

In this air conditioning indoor unit, the Coanda air flow travels away from the air inlet, so short-circuiting is prevented.

An air conditioning indoor unit pertaining to an eighth aspect of the present invention is the air conditioning indoor unit pertaining to any one of the first aspect to the seventh aspect, wherein a lengthwise direction dimension of the second air direction adjustment plate is equal to or greater than a lengthwise direction dimension of the first air direction adjustment plate.

In this air conditioning indoor unit, the second air direction adjustment plate receives all of the outlet air whose air direction has been adjusted by the first air direction adjustment plate, so short-circuiting of the outlet air from the sides of the second air direction adjustment plate is prevented.

An air conditioning indoor unit pertaining to a ninth aspect of the present invention is the air conditioning indoor unit pertaining to any one of the first aspect to the eighth aspect, wherein the second air direction adjustment plate rotates about a predetermined rotating shaft. The rotating shaft is disposed in a place away from the blowing path.

In this air conditioning indoor unit, the second air direction adjustment plate assumes, by rotating, a posture in which the height position of its rear end portion is tower than it is when operation is stopped. Therefore, the rear end portion enters the upstream side of the traveling path of the outlet air whose air direction has been adjusted by the first air direction adjustment plate, so it becomes easy for a Coanda air flow resulting from the Coanda effect to be produced further on the upstream side.

An air conditioning indoor unit pertaining to a tenth aspect of the present invention is the air conditioning indoor unit pertaining to the first aspect, wherein the control unit has a downward blowing mode. The downward blowing mode is a mode in which front ends of the first air direction adjustment plate and the second air direction adjustment plate are pointed frontward and downward to thereby guide the outlet air downward.

In this air conditioning indoor unit, in the downward blowing mode, the air direction can be changed further downward. Particularly when the first air direction adjustment plate is pointed further downward than the direction tangential to the terminal end portion of the scroll, it is not easy to control the air direction with just the first air direction adjustment plate, but it becomes easy for a downward air flow to be generated because there is the second air direction adjustment plate.

An air conditioning indoor unit pertaining to an eleventh aspect of the present invention is the air conditioning indoor unit pertaining to the first aspect, wherein the posture of the indoor unit front portion when operation is stopped and during operation is the same.

In this air conditioning indoor unit, by executing the Coanda effect utilization mode, the outlet air whose air direction has been adjusted by the first air direction adjustment plate can be changed to a Coanda air flow which, because of the Coanda effect, flows along the undersurface of the second air direction adjustment plate positioned away from the indoor unit front portion. As a result, compared to a conventional configuration that generates an air flow along the front panel, it becomes possible for the outlet air to be guided in a predetermined direction with the air outlet remaining unobstructed. That is, the outlet air is guided in a predetermined direction in a state in which air resistance is kept low.

An air conditioning indoor unit pertaining to a twelfth aspect of the present invention is the air conditioning indoor unit pertaining to the first aspect, wherein in the Coanda effect utilization mode, a rear end of the second air direction adjustment plate enters a traveling path of the outlet air. As a result, in this air conditioning indoor unit, it becomes easy for a Coanda air flow resulting from the Coanda effect to be produced.

Advantageous Effects of Invention

In the air conditioning indoor unit pertaining to the first aspect or the eleventh aspect of the present invention, by executing the Coanda effect utilization mode, the outlet air whose air direction has been adjusted by the first air direction adjustment plate can be changed to a Coanda air flow which, because of the Coanda effect, flows along the undersurface of the second air direction adjustment plate positioned away from the indoor unit front portion. As a result, compared to a conventional configuration that generates an air flow along the front panel, it becomes possible for the outlet air to be guided in a predetermined direction with the air outlet remaining unobstructed. That is, the outlet air is guided in a predetermined direction in a state in which air resistance is kept low.

In the air conditioning indoor unit pertaining to the second aspect of the present invention, it becomes possible for the outlet air to be deflected to a large extent from the direction tangential to the terminal end portion of the scroll. Therefore, the outlet air is directed toward the ceiling surface and is delivered far along the ceiling surface.

In the air conditioning indoor unit pertaining to the third aspect of the present invention, even when the outlet air whose air direction has been adjusted by the first air direction adjustment plate is horizontal or a little downward, it becomes upward air because of the Coanda effect, on it is not necessary for the air just after passage through the air outlet to be forcibly directed upward. That is, the air direction is changed while pressure loss caused by the air resistance of the first air direction adjustment plate is suppressed.

In the air conditioning indoor unit pertaining to the fourth aspect of the present invention, the front end portion of the second air direction adjustment plate is positioned higher than the air outlet, so the generation of a strong air flow on the upper side of the second air direction adjustment plate is suppressed. Therefore, it becomes difficult for the upward guidance of the Coanda air flow to be impeded.

In the air conditioning indoor unit pertaining to the fifth aspect of the present invention, the rear end portion of the second air direction adjustment plate enters the upstream side of the traveling path of the outlet air whose air direction has been adjusted by the first air direction adjustment plate, so compared to a type where the rear end portion does not move, it becomes easy for a Coanda air flow resulting from the Coanda effect further on the upstream side to be produced.

In the air conditioning indoor unit pertaining to the sixth aspect of the present invention, the front end portion of the second air direction adjustment plate projects outward from the air outlet, so the Coanda air flow reaches farther.

In the air conditioning indoor unit pertaining to the seventh aspect of the present invention, the Coanda air flow travels away from the air inlet, so short-circuiting is prevented.

In the air conditioning indoor unit pertaining to the eighth aspect of the present invention, the second air direction adjustment plate receives all of the outlet air whose air direction has been adjusted by the first air direction adjustment plate, so short-circuiting of the outlet air from the sides of the second air direction adjustment plate is prevented.

In the air conditioning indoor unit pertaining to the ninth aspect of the present invention, the second air direction adjustment plate assumes, by rotating, a posture in which the height position of its rear end portion is lower than it is when operation is stopped. Therefore, the rear end portion enters the upstream side of the traveling path of the outlet air whose air direction has been adjusted by the first air direction adjustment plate, so it becomes easy for a Coanda air flow resulting from the Coanda effect to be produced further on the upstream side.

In the air conditioning indoor unit pertaining to the tenth aspect of the present invention, in the downward blowing mode, the air direction can be changed further downward. Particularly when the first air direction adjustment plate is pointed further downward than the direction tangential to the terminal end portion of the scroll, it is not easy to control the air direction with just the first air direction adjustment plate, but it becomes easy for a downward Coanda air flow to be generated because there is the second air direction adjustment plate.

In the air conditioning indoor unit pertaining to the twelfth aspect of the present invention, it becomes easy for a Coanda air flow resulting from the Coanda effect to be produced.

DESCRIPTION OF EMBODIMENT

An embodiment of the present invention will be described below with reference to the drawings. The embodiment below is a specific example of the present invention and is not intended to limit the technical scope of the present invention.

(1) Configuration of Air Conditioning Indoor Unit 10

Figure 1:
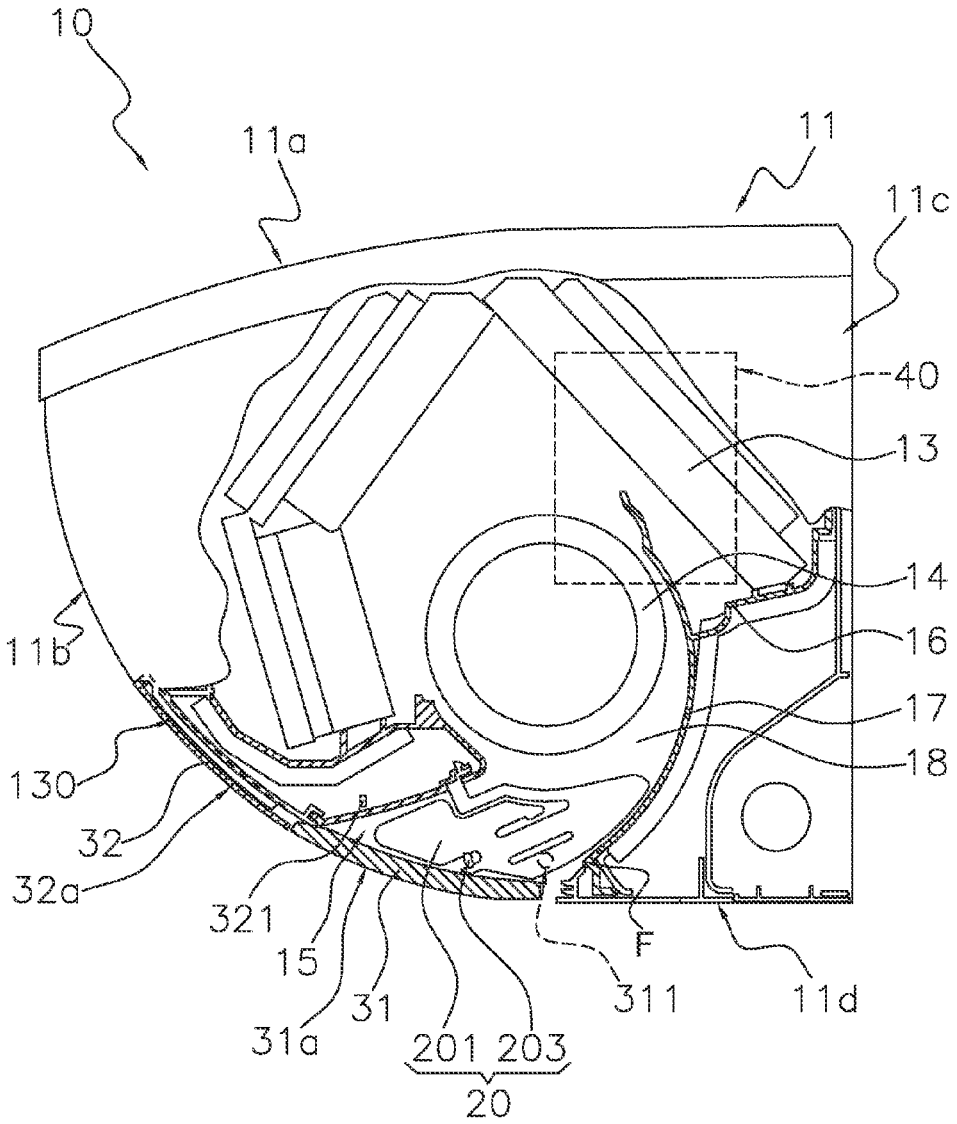
FIG. 1 is a cross-sectional view of an air conditioning indoor unit pertaining to an embodiment of the present invention when operation is stopped.
Figure 2:
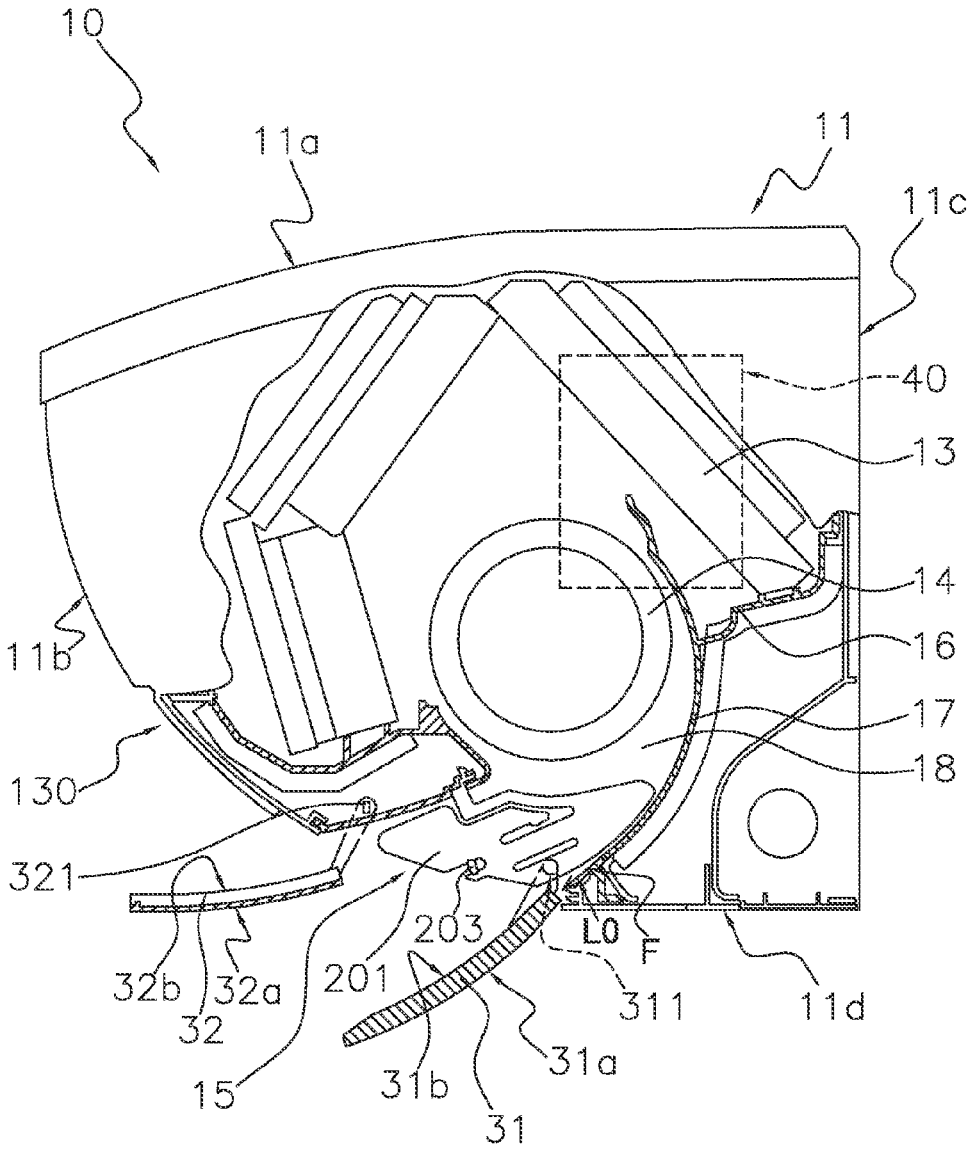
FIG. 2 is a cross-sectional view of the air conditioning indoor unit during operation.

FIG. 1 is a cross-sectional view of an air conditioning indoor unit 10 pertaining to an embodiment of the present invention when operation is stopped. Furthermore, FIG. 2 is a cross-sectional view of the air conditioning indoor unit 10 during operation. In FIG. 1 and FIG. 2, the air conditioning indoor unit 10 is a wall-mounted type and is equipped with a body casing 11, an indoor heat exchanger 13, an indoor fan 14, a bottom frame 16, and a control unit 40.

The body casing 11 has a top portion 11*a*, a front panel 11*b*, a back plate 11*c*, and a lower portion horizontal plate 11*d* and houses the indoor heat exchanger 13, the indoor fan 14, the bottom frame 16, and the control unit 40 inside.

The top portion 11*a* is positioned on the upper portion of the body casing 11, and an air inlet (not shown in the drawings) is disposed in the front portion of the top portion 11*a*.

The front panel 11*b* configures the front portion of the indoor unit and has a flat shape with no air inlet. Furthermore, the upper end of the front panel 11*b* is rotatably supported on the top portion 11*a*, so that the front panel 11*b* can move in a hinged manner.

The indoor heat exchanger 13 and the indoor fan 14 are attached to the bottom frame 16. The indoor heat exchanger 13 performs heat exchange with air passing through it. Furthermore, the indoor heat exchanger 13 has a shape of inverted V that is bent with both ends extending downward as seen in a side view, and the indoor fan 14 is positioned under the indoor heat exchanger 13. The indoor fan 14 is a cross-flow fan, applies air taken in from a room to the indoor heat exchanger 13, causes the air to pass through the indoor heat exchanger 13, and blows out the air into the room.

An air outlet 15 is disposed in the lower portion of the body casing 11. A first air direction adjustment plate 31 that changes the direction of outlet air blown out from the air outlet 15 is rotatably attached to the air outlet 15. The first air direction adjustment plate 31 is driven by a motor (not shown in the drawings) and can not only change the direction of the outlet air but also open and close the air outlet 15. The first air direction adjustment plate 31 can assume plural postures whose angles of inclination are different.

Furthermore, a second air direction adjustment plate 32 is disposed in the neighborhood of the air outlet 15. The second air direction adjustment plate 32 can assume a posture in which it is inclined in a front and rear direction because of a motor (not shown in the drawings) and, when operation is stopped, is housed in a housing portion 130 disposed in the front panel 11*b*. The second air direction adjustment plate 32 can assume plural postures whose angles of inclination are different.

Furthermore, the air outlet 15 is connected to the inside of the body casing 11 by an outlet air flow path 18. The outlet air flow path 18 is formed along a scroll 17 of the bottom frame 16 from the air outlet 15.

Room air is sucked by the operation of the indoor fan 14 into the indoor fan 14 via the air inlet and the indoor heat exchanger 13 and is blown out from the air outlet 15 via the outlet air flow path 18 from the indoor fan 14.

The control unit 40 is positioned on the right side of the indoor heat exchanger 13 and the indoor fan 14 when the body casing 11 is seen from the front panel 11*b* and controls the speed of the indoor fan 14 and controls the movement of the first air direction adjustment plate 31 and the second air direction adjustment plate 32.

(2) Detailed Configuration (2-1) Front Panel 11*b*

As shown in FIG. 1, the front panel 11*b* extends from the front of the upper portion of the body casing 11 toward the front edge of the lower portion horizontal plate 11*d* while drawing a gentle, circular arcuate curved surface. In the lower portion of the front panel 11*b*, there is a region that is recessed toward the inside of the body casing 11. The recessed depth of this region is set in such a way as to match the thickness dimension of the second air direction adjustment plate 32 to thereby form the housing portion 130 in which the second air direction adjustment plate 32 is housed. The surface of the housing portion 130 is also a gentle, circular arcuate curved surface.

(2-2) Air Outlet 15

As shown in FIG. 1, the air outlet 15 is formed in the lower portion of the body casing 11 and is a rectangular opening whose long edges lie along the transverse direction (the direction orthogonal to the page of FIG. 1). The lower end of the air outlet 15 is adjacent to the front edge of the lower portion horizontal plate 11*d*, and a hypothetical plane joining the lower end and the upper end of the air outlet 15 is inclined frontward and upward.

(2-3) Scroll 17

The scroll 17 is a partition wall curved in such a way as to oppose the indoor fan 14 and is part of the bottom frame 16. A terminal end F of the scroll 17 reaches as far as the neighborhood of the peripheral edge of the air outlet 15. The air traveling through the outlet air flow path 18 proceeds along the scroll 17 and is sent in a direction tangential to the terminal end F of the scroll 17. Consequently, if the first air direction adjustment plate 31 were not in the air outlet 15, the direction of the outlet air blown out from the air outlet 15 would be a direction generally along a tangent L0 to the terminal end F of the scroll 17.

(2-4) Vertical Air Direction Adjustment Plate 20

As shown in FIG. 1 and FIG. 2, a vertical air direction adjustment plate 20 has plural blade pieces 201 and a coupling rod 203 that couples together the plural blade pieces 201. Furthermore, the vertical air direction adjustment plate 20 is disposed further in the neighborhood of the indoor fan 14 than the first air direction adjustment plate 31 in the outlet air flow path 18.

When the coupling rod 203 reciprocates horizontally along the lengthwise direction of the air outlet 15, the plural blade pieces 201 swing right and left about a vertical state with respect to that lengthwise direction. The coupling rod 203 is horizontally reciprocated by a motor (not shown in the drawings).

(2-5) First Air Direction Adjustment Plate 31

The first air direction adjustment plate 31 has an area sufficient enough that it can close the air outlet 15. In a state in which the first air direction adjustment plate 31 is closing the air outlet 15, an outside surface 31*a* of the first air direction adjustment plate 31 is finished to a gentle, circular arcuate curved surface that is outwardly convex in such a way as to lie on an extension of the curved surface of the front panel 11*b*. Furthermore, an inside surface 31*b* (see FIG. 2) of the first air direction adjustment plate 31 is also a circular arcuate curved surface substantially parallel to the outer surface.

The first air direction adjustment plate 31 has a rotating shaft 311 on its lower end portion. The rotating shaft 311 is coupled to a rotating shaft of a stepping motor (not shown in the drawings) fixed to the body casing 111 in the neighborhood of the lower end of the air outlet 15.

When the rotating shaft 311 rotates in a counter-clockwise direction looking straight at FIG. 1, the upper end of the first air direction adjustment plate 311 moves away from the upper end side of the air outlet 15 and opens the air outlet 15. Conversely, when the rotating shaft 311 rotates in a clockwise direction looking straight at FIG. 1, the upper end of the first air direction adjustment plate 31 moves closer to the upper end side of the air outlet 15 and closes the air outlet 15.

In a state in which the first air direction adjustment plate 31 is opening the air outlet 15, the outlet air that has been blown out from the air outlet 15 flows generally along the inside surface 31*b* of the first air direction adjustment plate 31. That is, the outlet air that has been blown out generally along the direction tangential to the terminal end F of the scroll 17 has its air direction changed a little upward by the first air direction adjustment plate 31.

(2-6) Second Air Direction Adjustment Plate 32

The second air direction adjustment plate 32 is housed in the housing portion 130 while air conditioning operations are stopped and during operation in a later-described normal blow-out mode. The second air direction adjustment plate 32 moves away from the housing portion 130 by rotating. A rotating shaft 321 of the second air direction adjustment plate 32 is disposed in the neighborhood of the lower end of the housing portion 130 and in a position inside the body casing 11 (a position above an upper wall of the outlet air flow path 18), and the lower end portion of the second air direction adjustment plate 32 and the rotating shaft 321 are coupled together with a predetermined interval being kept in between them. Therefore, the height position of the tower end of the second air direction adjustment plate 32 becomes tower the more the rotating shaft 321 rotates so that the second air direction adjustment plate 32 moves away from the housing portion 130 of the indoor unit front portion. Furthermore, the inclination of the second air direction adjustment plate 32 when it has rotated open is gentler than the inclination of the indoor unit front portion.

In the present embodiment, the housing portion 130 is disposed outside a blowing path, and, when housed, the entire second air direction adjustment plate 32 is housed outside the blowing path. Instead of this structure, only part of the second air direction adjustment plate 32 may also be housed outside the blowing path, with the remainder being housed in the blowing path (e.g., the upper wall portion of the blowing path).

Furthermore, when the rotating shaft 321 rotates in a counter-clockwise direction looking straight at FIG. 1, both the upper end and the lower end of the second air direction adjustment plate 32 move away from the housing portion 130 while drawing a circular arc, but at this time, the shortest distance between the upper end and the housing portion 130 of the indoor unit front portion above the air outlet is greater than the shortest distance between the lower end and the housing portion 130. That is, the second air direction adjustment plate 32 is controlled to a posture in which it lies further away from the indoor unit front portion heading frontward. Additionally, when the rotating shaft 321 rotates in a clockwise direction looking straight at FIG. 1, the second air direction adjustment plate 32 moves closer to the housing portion 130 and eventually is housed in the housing portion 130. Operating state postures of the second air direction adjustment plate 32 include a state in which the second air direction adjustment plate 32 is housed in the housing portion 130, a posture in which the second air direction adjustment plate 32 rotates to become inclined frontward and upward, a posture in which the second air direction adjustment plate 32 further rotates to become substantially horizontal, and a posture in which the second air direction adjustment plate 32 further rotates to become inclined frontward and downward.

In a state in which the second air direction adjustment plate 32 is housed in the housing portion 130, an outside surface 32*a* of the second air direction adjustment plate 32 is finished to a gentle, circular arcuate curved surface that is outwardly convex in such a way as to lie on an extension of the gentle, circular arcuate curved surface of the front panel 11*b*. Furthermore, an inside surface 32*b* of the second air direction adjustment plate 32 is finished to a circular arcuate curved surface that is along the surface of the housing portion 130.

Furthermore, a lengthwise direction dimension of the second air direction adjustment plate 32 is set equal to or greater than a lengthwise direction dimension of the first air direction adjustment plate 31. The reason for this is because the second air direction adjustment plate 32 receives all of the outlet air whose air direction has been adjusted by the first air direction adjustment plate 31, and the purpose of this is to prevent short-circuiting of the outlet air from the sides of the second air direction adjustment plate 32.

(3) Directional Control of Outlet Air

The air conditioning indoor unit of the present embodiment has, as means of controlling the direction of the outlet air, a normal blow-out mode in which only the first air direction adjustment plate 31 is rotated to thereby adjust the direction of the outlet air, a Coanda effect utilization mode in which the first air direction adjustment plate 31 and the second air direction adjustment plate 32 are rotated to thereby utilize the Coanda effect to change the outlet air to a Coanda air flow along the outside surface 32*a* of the second air direction adjustment plate 32, and a downward blowing mode in which the front ends of the first air direction adjustment plate 31 and the second air direction adjustment plate 32 are pointed frontward and downward to thereby guide the outlet air downward.

The postures of the first air direction adjustment plate 31 and the second air direction adjustment plate 32 change with each air blow-out direction in each mode, so each posture will be described with reference to FIG. 3A to FIG. 3E. The user can select the blow-out direction via a remote controller or the like. Furthermore, it is also possible to control the changing of the modes and the blow-out direction in such a way that they are automatically changed.

(3-1) Normal Blow-Out Mode

The normal blow-out mode is a mode in which only the first air direction adjustment plate 31 is rotated to thereby adjust the direction of the outlet air, and includes "normal frontward blowing" and "normal frontward and downward blowing."

(3-1-1) Normal Frontward Blowing

Figure 3A:
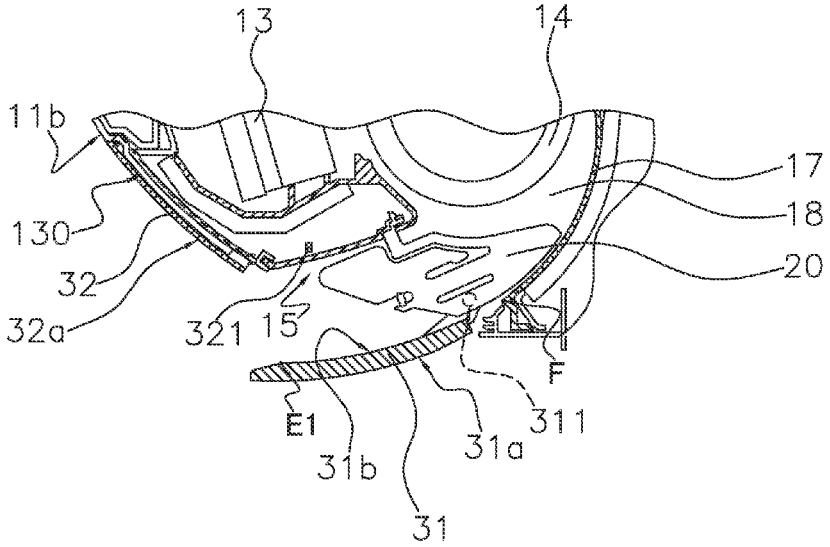
FIG. 3A is a side view of a first air direction adjustment plate and a second air direction adjustment plate during normal frontward blowing of outlet air.

FIG. 3A is a side view of the first air direction adjustment plate 31 and the second air direction adjustment plate 32 during normal frontward blowing of the outlet air. In FIG. 3A, when the user has selected "normal frontward blowing," the control unit 40 rotates the first air direction adjustment plate 31 to a position in which the inside surface 31*b* of the first air direction adjustment plate 31 becomes substantially horizontal. In a case where the inside surface 31*b* of the first air direction adjustment plate 31 is a circular arcuate curved surface like in the present embodiment, the control unit 40 rotates the first air direction adjustment plate 31 until a tangent to a front end E1 of the inside surface 31*b* becomes substantially horizontal. As a result, the outlet air becomes blown out frontward.

(3-1-2) Normal Frontward and Downward Blowing

Figure 3B:
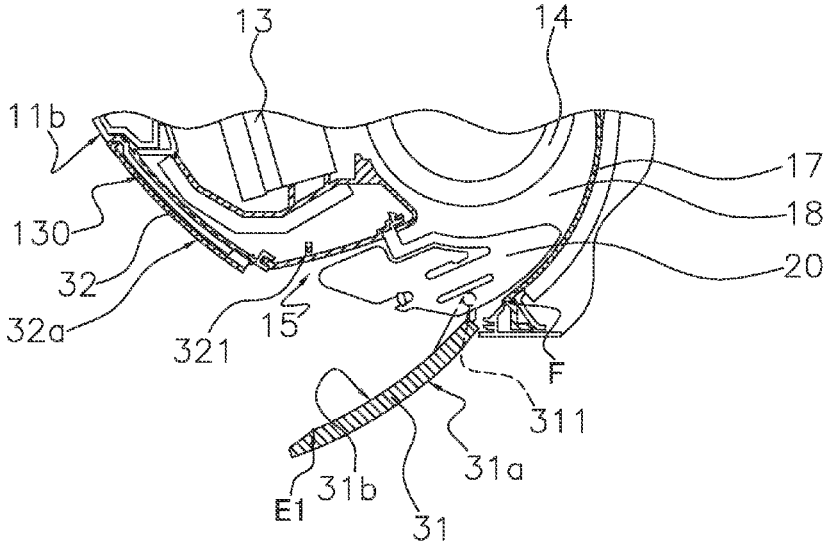
FIG. 3B is a side view of the first air direction adjustment plate and the second air direction adjustment plate during normal frontward and downward blowing of the outlet air.

FIG. 3B is a side view of the first air direction adjustment plate 31 and the second air direction adjustment plate 32 during normal frontward and downward blowing of the outlet air. In FIG. 3B, when the user wants to direct the blow-out direction to more downward than in the "normal frontward blowing," the user selects the "normal frontward and downward blowing."

At this time, the control unit 40 rotates the first air direction adjustment plate 31 until the tangent to the front end E1 of the inside surface 31*b* of the first air direction adjustment plate 31 becomes lower than horizontal. As a result, the outlet air becomes blown out frontward and downward.

(3-2) Coanda Effect Utilization Mode

Coanda (effect) is a phenomenon where, if there is a wall near the flow of a gas or liquid, the gas or liquid tends to flow in a direction along the wall surface even if the direction of the flow and the direction of the wall are different (*Hōsoku no jiten*, Asakura Publishing Co., Ltd.). The Coanda utilization mode includes "Coanda air flow frontward blowing" and "Coanda air flow ceiling blowing," which utilize the Coanda effect.

Figure 4A:
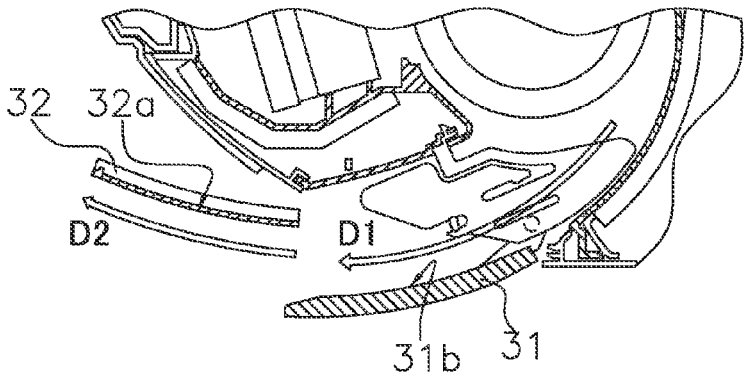
FIG. 4A is a conceptual drawing showing the direction of the outlet air and the direction of a Coanda air flow.

Furthermore, how the direction of the outlet air and the direction of the Coanda air flow are defined differs depending on how the reference position is taken, but an example will be described below. FIG. 4A is a conceptual drawing showing the direction of the outlet air and the direction of the Coanda air flow. In FIG. 4A, in order to produce the Coanda effect on the outside surface 32*a* side of the second air direction adjustment plate 32, it is necessary for the inclination of the direction (D1) of the outlet air that has been changed by the first air direction adjustment plate 31 to become closer to the posture (inclination) of the second air direction adjustment plate 32. If both are too far away from one another, the Coanda effect will not be produced. For that reason, in the Coanda effect utilization mode, it is necessary for the second air direction adjustment plate 32 and the first air direction adjustment plate 31 to be equal to or less than a predetermined open angle, and it is ensured that the relationship described above is established by ensuring that both adjustment plates (31 and 32) are within that range. Because of this, as shown in FIG. 4A, after the air direction of the outlet air has been changed to D1 by the first air direction adjustment plate 31, the air direction of the outlet air is further changed to D2 by the Coanda effect.

Furthermore, in the Coanda effect utilization mode of the present embodiment, it is preferred that the second air direction adjustment plate 32 be in a position in front of (on the downstream side of the blow-out) and above the first air direction adjustment plate 31.

Figure 4B:
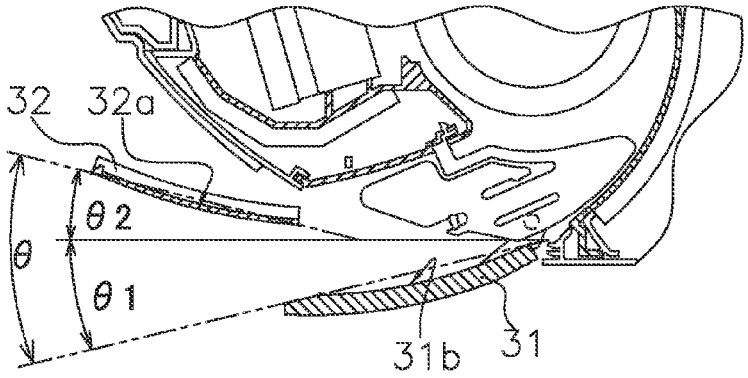
FIG. 4B is a conceptual drawing showing an example of an open angle between the first air direction adjustment plate and the second air direction adjustment plate.

Furthermore, how the open angle between the first air direction adjustment plate 31 and the second air direction adjustment plate 32 is defined differs depending on how the reference position is taken, but an example will be described below. FIG. 4B is a conceptual drawing showing an example of the open angle between the first air direction adjustment plate 31 and the second air direction adjustment plate 32. In FIG. 4B, when an angle of inclination θ1 of the first air direction adjustment plate 31 is defined as the angle between a straight line joining the front and rear ends of the inside surface 31*b* of the first air direction adjustment plate 31 and a horizontal line and an angle of inclination θ2 of the second air direction adjustment plate 32 is defined as the angle between a straight line joining the front and rear ends of the outside surface 32*a* of the second air direction adjustment plate 32 and the horizontal line, the open angle θ between the first air direction adjustment plate 31 and the second air direction adjustment plate 32 is equal to θ2−θ1. θ1 and θ2 are not absolute values and are negative values in a case where they are under the horizontal line looking straight at FIG. 4B.

In both the "Coanda air flow frontward blowing" and the "Coanda air flow ceiling blowing," it is preferred that the first air direction adjustment plate 31 and the second air direction adjustment plate 32 assume postures that satisfy a condition where an internal angle formed by a tangent to the terminal end F of the scroll 17 and the second air direction adjustment plate 32 is greater than an internal angle formed by the tangent to the terminal end F of the scroll 17 and the first air direction adjustment plate 31.

Figure 5A:
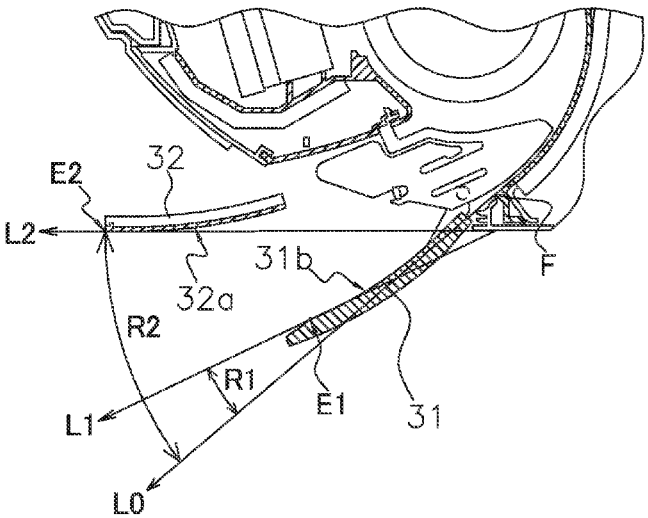
FIG. 5A is a comparative drawing of an internal angle formed by a tangent to a terminal end F of a scroll and the second air direction adjustment plate and an internal angle formed by the tangent to the terminal end F of the scroll and the first air direction adjustment plate during the Coanda air flow frontward blowing.
Figure 5B:
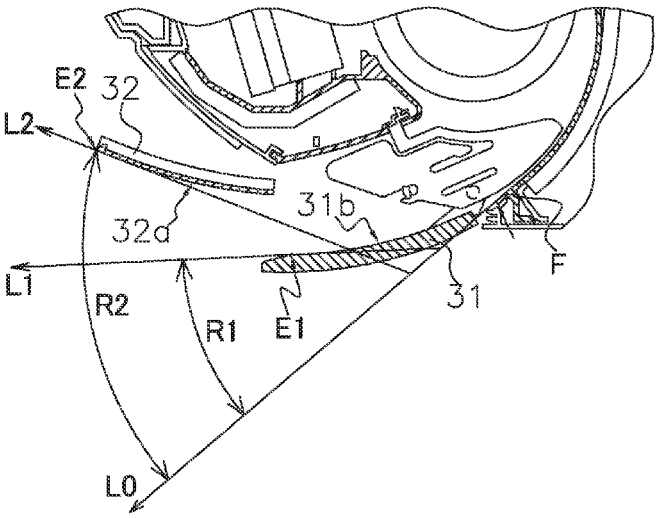
FIG. 5B is a comparative drawing of the internal angle formed by the tangent to the terminal end F of the scroll and the second air direction adjustment plate and the internal angle formed by the tangent to the terminal end F of the scroll and the first air direction adjustment plate during the Coanda air flow ceiling blowing.

Regarding the internal angles, refer to FIG. 5A (a comparative drawing of an internal angle R2 formed by the tangent L0 to the terminal end F of the scroll 17 and the second air direction adjustment plate 32 and an internal angle R1 formed by the tangent L0 to the terminal end F of the scroll 17 and the first air direction adjustment plate 31 during the Coanda air flow frontward blowing) and FIG. 5B (a comparative drawing of the internal angle R2 formed by the tangent L0 to the terminal end F of the scroll 17 and the second air direction adjustment plate 32 and the internal angle R1 formed by the tangent L0 to the terminal end F of the scroll 17 and the first air direction adjustment plate 31 during the Coanda air flow ceiling blowing).

Furthermore, as shown in FIG. 5A and FIG. 5B, in the second air direction adjustment plate 32 in the Coanda effect utilization mode, the front end portion of the second air direction adjustment plate 32 is positioned frontward and upward from the horizontal and outside and higher than the air outlet 15. As a result, the Coanda air flow reaches farther, the generation of a strong air flow that passes over the upper side of the second air direction adjustment plate is suppressed, and it becomes difficult for the upward guidance of the Coanda air flow to be impeded.

Furthermore, the height position of the rear end portion of the second air direction adjustment plate 32 is lower than it is when operation is stopped, so it is easy for a Coanda air flow resulting from the Coanda effect on the upstream side to be produced.

(3-2-1) Coanda Air Flow Frontward Blowing

Figure 3C:
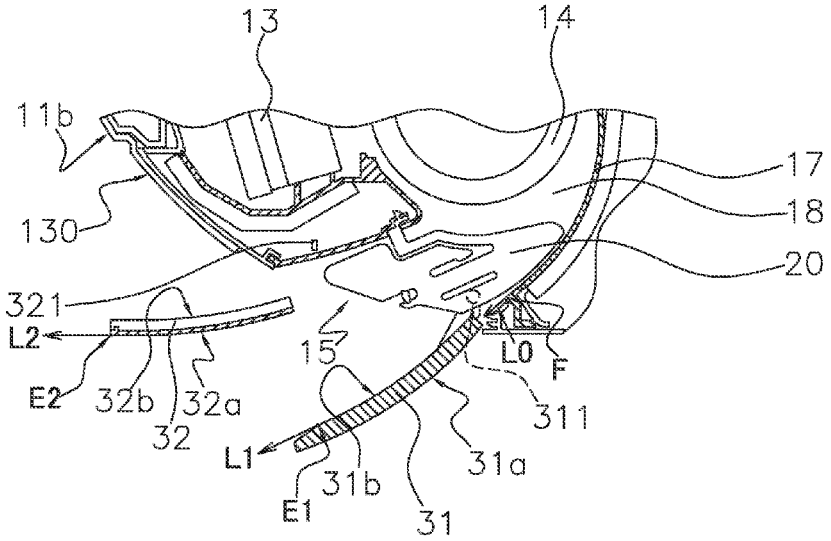
FIG. 3C is a side view of the first air direction adjustment plate and the second air direction adjustment plate during Coanda air flow frontward blowing.

FIG. 3C is a side view of the first air direction adjustment plate 31 and the second air direction adjustment plate 32 during the Coanda air flow frontward blowing. In FIG. 3C, when the "Coanda air flow frontward blowing" has been selected, the control unit 40 rotates the first air direction adjustment plate 31 until a tangent L1 to the front end E1 of the inside surface 31*b* of the first air direction adjustment plate 31 becomes lower than the horizontal.

Next, the control unit 40 rotates the second air direction adjustment plate 32 to a position in which the outside surface 32*a* of the second air direction adjustment plate 32 becomes substantially horizontal. In a case where the outside surface 32*a* of the second air direction adjustment plate 32 is a circular arcuate curved surface like in the present embodiment, the control unit 40 rotates the second air direction adjustment plate 32 until a tangent L2 to a front end E2 of the outside surface 32*a* becomes substantially horizontal. That is, as shown in FIG. 5A, the internal angle R2 formed by the tangent L0 and the tangent L2 becomes greater than the internal angle R1 formed by the tangent L0 and the tangent L1.

The outlet air that has been adjusted so as to be blown out frontward and downward by the first air direction adjustment plate 31 becomes a flow attached to the outside surface 32*a* of the second air direction adjustment plate 32 because of the Coanda effect and changes to a Coanda air flow along the outside surface 32*a*.

Consequently, even when the direction of the tangent L1 to the front end E1 of the first air direction adjustment plate 31 is frontward and downward blowing, the outlet air is, because of the Coanda effect, blown out in the direction of the tangent L2 to the front end E2 of the outside surface 32*a* of the second air direction adjustment plate 32—that is, in the horizontal direction—because the direction of the tangent L2 to the front end E2 of the second air direction adjustment plate 32 is horizontal.

In this way, the second air direction adjustment plate 32 moves away from the indoor unit front portion, the inclination becomes gentle, and the outlet air becomes susceptible to the Coanda effect in front of the front panel 11*b*. As a result, even when the outlet air whose air direction has been adjusted by the first air direction adjustment plate 31 is blown frontward and downward, it becomes horizontally blown air because of the Coanda effect. Compared to the conventional (patent document 1) method of bringing the air just after passage through the air outlet closer to the front panel and utilizing the Coanda effect of the front panel to direct the air upward, the air direction is changed while pressure loss caused by the air resistance of the first air direction adjustment plate 31 is suppressed.

(3-2-2) Coanda Air Flow Ceiling Blowing

Figure 3D:
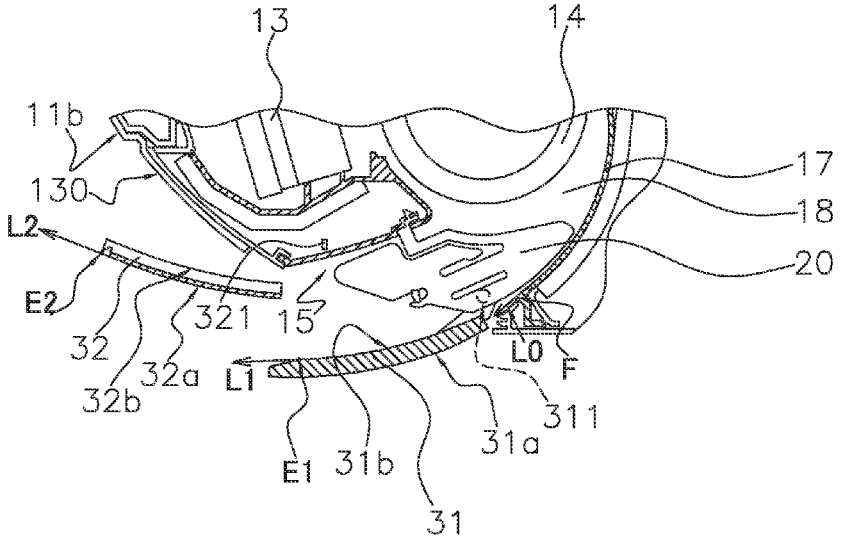
FIG. 3D is a side view of the first air direction adjustment plate and the second air direction adjustment plate during Coanda air flow ceiling blowing.

FIG. 3D is a side view of the first air direction adjustment plate 31 and the second air direction adjustment plate 32 during the Coanda air flow ceiling blowing. In FIG. 3D, when the "Coanda air flow ceiling blowing" has been selected, the control unit 40 rotates the first air direction adjustment plate 31 until the tangent L1 to the front end E1 of the inside surface 31*b* of the first air direction adjustment plate 31 becomes horizontal.

Next, the control unit 40 rotates the second air direction adjustment plate 32 until the tangent L2 to the front end E2 of the outside surface 32*a* points frontward and upward. That is, as shown in FIG. 5B, the internal angle R2 formed by the tangent L0 and the tangent L2 becomes greater than the internal angle R1 formed by the tangent L0 and the tangent L1. The outlet air that has been adjusted in such a way as to be blown out horizontally by the first air direction adjustment plate 31 becomes a flow attached to the outside surface 32*a* of the second air direction adjustment plate 32 because of the Coanda effect and changes to a Coanda air flow along the outside surface 32*a*.

Consequently, even when the direction of the tangent L1 to the front end E1 of the first air direction adjustment plate 31 is frontward blowing, the outlet air is, because of the Coanda effect, blown out in the direction of the tangent L2 to the front end E2 of the outside surface 32*a* of the second air direction adjustment plate 32—that is, in the direction of the ceiling—because the direction of the tangent L2 to the front end E2 of the second air direction adjustment plate 32 is frontward and upward blowing. Because the front end portion of the second air direction adjustment plate 32 projects outward from the air outlet 15, the Coanda air flow reaches farther. Moreover, because the front end portion of the second air direction adjustment plate 32 is positioned higher than the air outlet 15, the generation of an air flow that passes over the upper side of the second air direction adjustment plate is suppressed, and it is difficult for the upward guidance of the Coanda air flow to be impeded.

In this way, the second air direction adjustment plate 32 moves away from the indoor unit front portion, the inclination becomes gentle, and the outlet air becomes susceptible to the Coanda effect in front of the front panel 11*b*. As a result, even when the outlet air whose air direction has been adjusted by the first air direction adjustment plate 31 is blown frontward, it becomes upward air because of the Coanda effect. Compared to the conventional (patent document 1) method of bringing the air just after passage through the air outlet closer to the front panel and utilizing the Coanda effect of the front panel to direct the air upward, the air direction is changed while pressure loss caused by the air resistance of the first air direction adjustment plate 31 is suppressed.

As a result, compared to the invention in patent document 1 that generates an air flow along the front panel, the outlet air is guided in the direction of the ceiling with the air outlet 15 remaining unobstructed. That is, the outlet air is guided in the direction of the ceiling in a state in which air resistance is kept low.

The lengthwise direction dimension of the second air direction adjustment plate 32 is equal to or greater than the lengthwise direction dimension of the first air direction adjustment plate 31. Therefore, the second air direction adjustment plate 32 can receive all of the outlet air whose air direction has been adjusted by the first air direction adjustment plate 31, and there is also the effect that short-circuiting of the outlet air from the sides of the second air direction adjustment plate 32 is prevented.

(3-3) Downward Blowing Mode

Figure 3E:
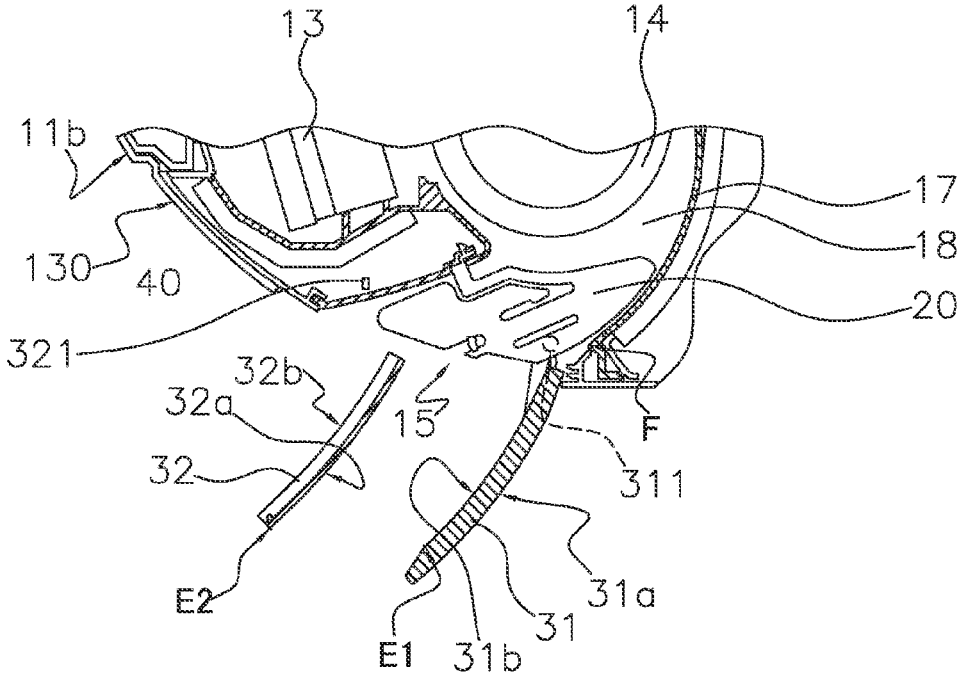
FIG. 3E is a side view of the first air direction adjustment plate and the second air direction adjustment plate during downward blowing.

FIG. 3E is a side view of the first air direction adjustment plate 31 and the second air direction adjustment plate 32 during the downward blowing. In FIG. 3E, when the "downward blowing" has been selected, the control unit 40 rotates the first air direction adjustment plate 31 until the tangent to the front end E1 of the inside surface 31*b* of the first air direction adjustment plate 31 points downward.

Next, the control unit 40 rotates the second air direction adjustment plate 32 until the tangent to the front end E2 of the outside surface 32*a* points downward. As a result, the outlet air passes between the first air direction adjustment plate 31 and the second air direction adjustment plate 32 and is blown out downward.

In particular, even when the first air direction adjustment plate 31 points more downward than the tangential angle of the terminal end portion of the scroll 17, a downward air flow can be generated and applied to the outside surface 32*a* of the second air direction adjustment plate 32 as a result of the control unit 40 executing the downward blowing mode.

(4) Characteristics (4-1)

In the air conditioning indoor unit 10, the control unit 40 executes the Coanda effect utilization mode, whereby the outlet air whose air direction has been adjusted by the first air direction adjustment plate 31 can be changed to a Coanda air flow which, because of the Coanda effect, flows along the undersurface of the second air direction adjustment plate 32 positioned away from the indoor unit front portion. As a result, compared to the conventional configuration that generates an air flow along the front panel 11*b*, the outlet air is guided in a predetermined direction in a state in which air resistance is kept low and with the air outlet 15 remaining unobstructed.

(4-2)

Furthermore, when the control unit 40 executes the Coanda effect utilization mode, the first air direction adjustment plate 31 and the second air direction adjustment plate 32 assume postures that satisfy a condition where "the internal angle formed by the tangent to the terminal end portion of the scroll 17 and the second air direction adjustment plate 32 is greater than the internal angle formed by the tangent to the terminal end portion of the scroll 17 and the first air direction adjustment plate 31." As a result, the outlet air is directed toward the ceiling surface and is delivered far along the ceiling surface.

(4-3)

Furthermore, in the Coanda effect utilization mode, the front end portion of the second air direction adjustment plate 32 points frontward and upward from the horizontal. As a result, even when the outlet air whose air direction has been adjusted by the first air direction adjustment plate 31 is horizontal or a little downward, it becomes upward air because of the Coanda effect, so it is not necessary for the air just after passage through the air outlet 15 to be forcibly directed upward, and the air direction is changed while pressure loss caused by the air resistance of the first air direction adjustment plate 31 is suppressed.

(4-4)

Furthermore, in the Coanda effect utilization mode, the front end portion of the second air direction adjustment plate 32 is positioned higher than the air outlet. As a result, the generation of an air flow that passes over the upper side of the second air direction adjustment plate is suppressed, and it becomes difficult for the upward guidance of the Coanda air flow to be impeded.

(4-5)

Furthermore, in the Coanda effect utilization mode, the height position of the rear end portion of the second air direction adjustment plate 32 is lower than it is when operation is stopped. As a result, the rear end portion of the second air direction adjustment plate 32 enters the upstream side of the traveling path of the outlet air whose air direction has been adjusted by the first air direction adjustment plate 31, and it becomes easy for a Coanda air flow resulting from the Coanda effect on the upstream side to be produced.

(4-6)

Furthermore, in the Coanda effect utilization mode, the front end portion of the second air direction adjustment plate 32 projects outward from the air outlet. As a result, the Coanda air flow can be delivered farther.

(4-7)

Furthermore, the shortest distance between the front end of the second air direction adjustment plate 32 and the body casing 11 is greater than the shortest distance between the rear end of the second air direction adjustment plate 32 and the body casing 11. As a result, the Coanda air flow travels away from the air inlet, so short-circuiting is prevented.

(4-8)

Furthermore, the lengthwise direction dimension of the second air direction adjustment plate 32 is equal to or greater than the lengthwise direction dimension of the first air direction adjustment plate 31. As a result, the second air direction adjustment plate 32 receives all of the outlet air whose air direction has been adjusted by the first air direction adjustment plate 31, and short-circuiting of the outlet air from the sides of the second air direction adjustment plate 32 is prevented.

(4-9)

Furthermore, the second air direction adjustment plate 32 rotates about the rotating shaft disposed in a place away from the blowing path, so the height position of the rear end portion becomes lower than it is when operation is stopped. Therefore, the rear end portion enters the upstream side of the traveling path of the outlet air whose air direction has been adjusted by the first air direction adjustment plate 31, and it becomes easy for a Coanda air flow resulting from the Coanda effect to be produced further on the upstream side.

(4-10)

Furthermore, the control unit 40 has the downward blowing mode in which the front ends of the first air direction adjustment plate 31 and the second air direction adjustment plate 32 are pointed frontward and downward to thereby guide the outlet air downward. When the first air direction adjustment plate 31 is pointed further downward than the tangential angle of the terminal end portion of the scroll 17, a downward air flow along the outside surface 32*a* of the second air direction adjustment plate 32 is generated as a result of the control unit 40 executing the downward blowing mode.

INDUSTRIAL APPLICABILITY

As described above, the present invention can guide the outlet air in a predetermined direction without obstructing the air outlet 115, so the present invention is particularly useful in wall-mounted air conditioning indoor units.

What is claimed is:

1. An air conditioning indoor unit having a Coanda effect utilization mode that utilizes the Coanda effect, which is a phenomenon where, if there is a wall surface near a flow of a gas, the gas tends to flow in a direction along the wall surface even if the direction of the flow and a direction of the wall surface are different, to guide, in a predetermined direction, a flow of outlet air blown out from an air outlet, the air conditioning indoor unit comprising:

an indoor unit front portion disposed outside a blowing path;

a movable first air direction adjustment plate configured to change an up and down direction of the outlet air;

a second air direction adjustment plate disposed adjacent to the air outlet, the second air direction adjustment plate including a front end portion and an outside surface, and when the second air direction adjustment plate is housed in the indoor unit front portion, the front end portion is housed in the indoor unit front portion, and the outside surface is outside the blowing path;

a control unit configured to control postures of the first air direction adjustment plate and the second air direction adjustment plate; and a scroll configured to guide air-conditioned air to the air outlet, in the Coanda effect utilization mode, the control unit controlling the postures of the first air direction adjustment plate and the second air direction adjustment plate in such a way that the second air direction adjustment plate assumes a posture in which the second air direction adjustment plate is spaced apart from the indoor unit front portion, and inside the blowing path, the outside surface is inside the blowing path, and a height position of a rear end portion of the second air direction adjustment plate is lower than when operation is stopped and the second air direction adjustment plate and the first air direction adjustment plate form a predetermined angle, when the second air direction adjustment plate and the first air direction adjustment plate form the predetermined angle, the second air direction adjustment plate and the first air direction adjustment plate generate an obliquely upward Coanda air flow along an undersurface of the second air direction adjustment plate because of the Coanda effect, and the predetermined angle formed by the postures of the first air direction adjustment plate and the second air adjustment plate generates the obliquely upward Coanda air flow the first air direction adjustment plate having an inside arcuate surface, the second air direction adjustment plate having an outside arcuate surface, and when the control unit executes the Coanda effect utilization mode, the first air direction adjustment plate and the second air direction adjustment plate assume postures that satisfy a condition where an internal angle formed by a tangent to a terminal end portion of the scroll and a tangent to a front end of the outside arcuate surface of the second air direction adjustment plate is greater than an internal angle formed by the tangent to the terminal end portion of the scroll and a tangent to a front end of the inside arcuate surface of the first air direction adjustment plate.

2. The air conditioning indoor unit according to claim 1, wherein in the Coanda effect utilization mode, a front end portion of the second air direction adjustment plate points frontward and upward from a horizontal.

3. The air conditioning indoor unit according to claim 2, wherein in the Coanda effect utilization mode, the front end portion of the second air direction adjustment plate is positioned higher than the air outlet.

4. The air conditioning indoor unit according to claim 1, wherein in the Coanda effect utilization mode, the front end portion of the second air direction adjustment plate projects outward from the air outlet.

5. The air conditioning indoor unit according to claim 1, wherein the second air direction adjustment plate rotates about a predetermined rotating shaft, and the rotating shaft is disposed at a location spaced from the blowing path.

6. The air conditioning indoor unit according to claim 1, wherein the control unit has a downward blowing mode in which front ends of the first air direction adjustment plate and the second air direction adjustment plate are pointed frontward and downward to guide the outlet air downward.

7. The air conditioning indoor unit according to claim 1, wherein a posture of the indoor unit front portion when operation is stopped and during operation is the same.

8. The air conditioning indoor unit according to claim 1, wherein in the Coanda effect utilization mode, a rear end of the second air direction adjustment plate enters a traveling path of the outlet air.

9. The air conditioning indoor unit according to claim 1, wherein the second air direction adjustment plate is fixed to a rotable arm at the rear end portion of the second air direction adjustment plate.

* * * * *